United States Patent [19]

Romig, Jr.

[11] 4,308,700

[45] Jan. 5, 1982

[54] FIBERGLASS STRUCTURAL MEMBER OF LAYER CONSTRUCTION AND METHOD OF MAKING SAME

[76] Inventor: Byron A. Romig, Jr., 3920 Eagle Rock Blvd., Los Angeles, Calif. 90065

[21] Appl. No.: 83,335

[22] Filed: Oct. 10, 1979

[51] Int. Cl.[3] ..... E04C 3/10; E04C 3/29

[52] U.S. Cl. ..... 52/225; 52/309.5; 52/731

[58] Field of Search ..... 52/309.13, 309.15, 309.17, 52/727, 723, 724, 225, 226, 223 R, 223 L; 156/173, 175; 428/377, 376, 188, 920, 70

[56] References Cited

U.S. PATENT DOCUMENTS

| | | | |
|---|---|---|---|
| 2,922,200 | 1/1960 | Atwood | 52/309.15 |
| 3,520,749 | 7/1970 | Rubenstein | 156/173 |
| 3,742,985 | 7/1973 | Rubenstein | 52/309.17 |
| 3,802,975 | 4/1974 | Saidla | 156/173 |
| 3,830,687 | 8/1974 | Carlore | 52/309.15 |

FOREIGN PATENT DOCUMENTS

| | | | |
|---|---|---|---|
| 560990 | 4/1959 | Italy | 52/723 |

OTHER PUBLICATIONS

Polyurethanes by Reinhold Publishing Corp. Reinhold Plastics Application Series, p. 67.

*Primary Examiner*—John E. Murtagh

*Attorney, Agent, or Firm*—Fulwider, Patton, Rieber, Lee & Utecht

[57] ABSTRACT

A structural member such as a beam formed by an inner layer of fiberglass that is filament wound about a mandrel, a middle layer of fire retardant material such as gypsum board, and an outer layer of filament wound fiberglass. In addition to its fire retardant function, the middle layer acts as a spacer between the inner and outer layers, thereby rigidifying the beam. Tendons extend throughout the length of the beam internally. They are connected to the top of the beam near its ends and to the bottom of the beam at one or more intermediate points, thus tending to lift the middle of the beam to prevent sagging. The tension on these tendons may be selected to meet any of a variety of load conditions.

6 Claims, 5 Drawing Figures

FIBERGLASS STRUCTURAL MEMBER OF LAYER CONSTRUCTION AND METHOD OF MAKING SAME

FIELD OF THE INVENTION

The present invention relates to structural members such as beams and, more particularly, to fiberglass structural members.

BACKGROUND OF THE INVENTION

Structural members such as beams must have the necessary strength to withstand the loads to which they will be subjected and must conform to a variety of other important parameters. Some of these parameters relate to safety in the event of a fire, the so called "fire rating" of the member. In this connection beams must be capable of sustaining a minimum rated load when subjected to specified high temperatures over a period of time so that the structure in which they are used will not become unstable too rapidly in the event of a fire.

Another consideration is the rigidity of the member which is particularly important in the case of beams since they tend to sag at the center. A beam which has excessive sag, camber or other deflection can be present serious construction problems even though it has sufficient strength because it will cause other members that it supports to be out of alignment and may, in extreme situations, cause these other members to fail. On the other hand, excessive rigidity may be undesirable, especially in earthquake prone areas.

At present, conventional construction techniques are becoming increasingly expensive, in large measure due to the cost of materials. One type of member for which costs have increased significantly is the so called "glue-lam" beam, which is of laminated wood construction and is commonly used in large non-residential structures such as supermarkets. The wood from which said beams are made, usually Douglass Fur, is available only in certain areas and transportation costs to other areas can be substantial. Moreover, the availability of glue-lam beams varies at different times and costly delays can result. It is also found that glue-lam beams are excessively heavy and their installation is, therefore, difficult.

Despite the need for inovation with respect to structural members, little use has been made of alternative materials such as fiberglass. This is partially due to the fact that fiberglass is extremely resilient and when used as a beam, for example, has unacceptable sag or camber despite the fact that it is other wise sufficiently strong. In addition, fiberglass typically is unable to retain its strength and integrity when subjected to high temperatures, even for short periods of time, and does not have an acceptable fire rating. State of the art fiberglass structural members are, therefore, in the majority of instances, incapable of meeting applicable building codes.

It is a principle objective of the present invention to provide an improved fiberglass structural member that overcomes the problems noted above. It is a further objective to provide such a member that has controllable resiliency.

SUMMARY OF THE INVENTION

The above-objectives are accomplished by a structural member, such as a beam, that includes an elongted closed, multi-sided inner layer of fibers and a bonding medium which has a substantial load bearing capacity.

This inner layer is contacted by a middle layer of fire retardant, heat resistant, insulating material such as a gypsum board. An outer layer is wrapped around the middle layer so that the middle layer is tightly and firmly held. Thus, in addition to its fire retardant function, the middle layer serves as a spacer between the inner and outer layers, thereby rigidifying the member. Preferably, the inner and outer layers are filament wound fiberglass wrapped around the sides, top and bottom of the member rather than extending longitudinally.

According to another aspect of the invention, one or more tendons extend lengthwise through the hollow interior of the beam. These tendons are secured to the top of the beam near its ends and are secured to an offset point nearer the bottom of the beam at one or more intermediate points. The effect of tension on these tendons is to raise the center of the beam, creating an anti-sag force. The proper tension may be selected to reduce or eliminate sagging and the attendant misalignment problems. Undesired rigidity can be avoided by reducing the tension. Thus, resiliency that is controllable within the desired range results from the coaction of the wrapped construction of the member and tendons.

Other features and advantages of the present invention will become apparent from the following detailed description, taken in conjunction with the accompanying drawings, which illustrate, by way of example, the principles of the invention.

DESCRIPTION OF THE PREFERRED EMBODIMENTS

Figures 1, 2, 3, 4, 5:
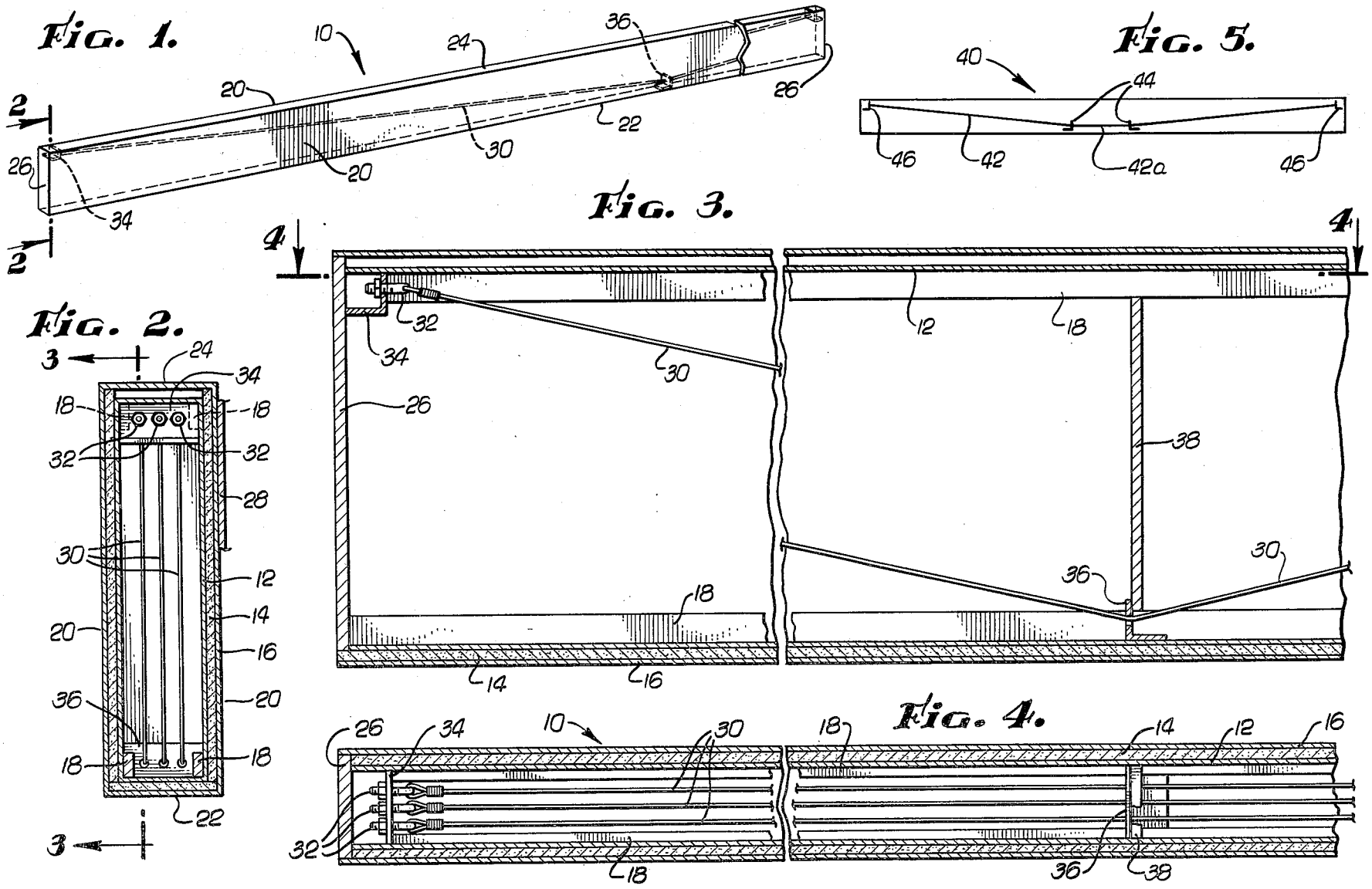
FIG. 1 is a three dimensional view of a structural member constructed in accordance with the present invention, a single representative internal tendon of the beam being shown in phantom lines.
FIG. 2 is a cross-sectional view of the member taken as indicated by the arrows 2 of FIG. 1 and shown on a larger scale.
FIG. 3 is a longitudinal cross-section view of a fragmentary portion of the member taken as indicated by the arrows 3 of FIG. 2.
FIG. 4 is another longitudinal cross-section view of the same fragmentary portion of the member shown in FIG. 3 but taken looking downwardly from the top as indicated by the arrows 4 of FIG. 3.
FIG. 5 is a schematic representation of a variation of the member shown in FIGS. 1–4.

A structural member 10, more specifically a beam shown in FIGS. 1–4, embodies the many advantages of the present invention. It has elongated, closed configuration of rectangular cross-section. By "closed" it is meant that the outer surfaces of the beam 10 come together to form a boxlike member with an open center.

As best shown in FIGS. 2, 3 and 4, the beam 10 includes three basic layers, an inner fiberglass (fiber and resin) layer 12, a middle layer 14 of insulating material, and an outer layer 16 of fiberglass. The inner layer 12 is filament wound around a mandrel 18 which includes four elongated corner pieces that correspond to each of the longitudinal corners of the beam 10. The filament is wrapped so that it extends around the two sides 20, the bottom 22 and the top 24 of the beam 10 perpendicular to the direction of elongation of the beam. Any of a variety of suitable readily available filaments and resins can be used. It is advantageous to employ a resin have fire retardant properties.

The middle layer 14 is formed by a fire retardant insulating material, preferably gypsum board. It is held in place against the inner layer 12 by the outer layer 16 which is filament wound in the same direction as the inner layer.

The load-bearing capacity of the beam 10 is provided by the inner and outer fiberglass layers 12 and 16. The middle layer 14, while offering no substantial structural strength as a separate element, is relatively compression resistant and acts as a spacer between the two fiberglass layers which tightly and firmly hold it. In this manner, the gypsum serves to rigidify the beam 10 without adding significantly to its cost and without unduly increasing its weight. The dimension of the beam 10 and thickness of the various layers are easily varied in accordance with the requirements of a particular situation.

The fire retardant middle layer 14 is also important from the point of view of safety. As long as this layer is held in place, it protects the inner fiberglass layer 12 from the heat of a fire. This inner layer 12 alone possesses sufficient load-bearing capacity to prevent the collapse of the structure in which is incorporated for a sufficient time to give the beam 10 an acceptable fire rating.

In the beam 10, the mandrel 18 remains in place and becomes a permanent part of the beam, but its primary function is merely to provide a skeleton on which the innermost layer 12 can be wound. Accordingly, the mandrel 18 can be removed prior to the completion of the beam if desired. A pair of end caps 26 close the ends of the beam 10 to improve its appearance. The decorative layer 28 may be a wood veneer or any other material chosen for its asthetic effect. The outer most layer 28 can also be a fire retardant material.

In general, beams have a tendency to sag downwardly at the middle under the force of the vertical loads to which they are subjected and their own weight. Since the beam 10 is essentially hollow, a unique arrangement can be employed to prevent sagging.

A set of parallel tendons 30, which may be steel cables, extend throughout the length of the beam 10. While any desired number of tendons 30 may be employed, three are used in the beam 10 of FIGS. 1–4 (only 1 such tendon being shown in FIG. 1 for purposes of illustration). The ends of the tendons 30 are secured by a set of fasteners 32 to top plates 34 that extend across the beam 10 near its upper interior surface at each end, the plates being secured to the mandrel 18. Alternatively, the top plates 30 can be secured to, formed with or interlocked with the inner layer 12. Each tendon 30 passes through an aperture in a bottom plate 36, also secured to the mandrel 18, that extends across the bottom of the beam 10 at its center. The apertures in the plate 36 are thus offset with respect to a straight line extending between the fasteners 32 and each tendon 30 has a shallow V-shaped configuration.

The tendons 30 are held in tension by the fasteners 32, which are threaded to permit adjustment of the tension forces. The tendons 30 may be tensioned at the time the beam 10 is manufactured or may be tensioned later at the job site, taking into account the loading of the particular beam. Since the tendons 30 are attached to the top of the beam 10 at the ends and nearer the bottom of the beam at the center, they tend to give the beam camber, lifting the center with a force proportional to the tension. This lifting force counteracts the tendency of the beam 10 to sag.

A vertical partition 38, which can be made of fiberglass, extends across the beam 10 just above the center plate 36 separating the top and bottom members of the mandrel 38 by a fixed distance. This partition 38 prevents collapse of the beam 10 and maintains its preselected vertical dimension so that the top of the beam as well as the bottom is prevented from sagging. If desired, more than one partition 38 can be employed, especially in the case of larger beams.

Regardless of whether the tendon tension is applied at time of the manufacture of the beam 10 or at the time of its installation, it is an important advantage of this construction that two otherwise identical beams can be made suitable for different load conditions by applying different tension forces to the tendons 30. Thus a relatively high tension may be applied to the tendons 30 for a beam that will carry a high center load. If, however, this beam 10 were used with a lower center load it would tend to have a reverse camber since the tendons 30, pushing upwardly on the partition 38, would lift the center of the beam. In that circumstance, a relatively low tension should be selected so that the beam 10 would remain true and straight. It will be noted that, in essence, the beam 10 is adjustable to eliminate deflection and can thus be used in a wide variety of situations in which it has sufficient strength and will not introduce alignment difficulties attributable to deflection.

The tendon arrangement compliments the wrapped construction of the beam 10. The wrapped construction, without the tendons 30, places the beam 10 within the proper range of elasticity. The tendons 30 provide fine turning to counteract any tendency to sag.

A variation of the beam 10 is represented by a beam 40, shown schematically in FIG. 5. It differs from the beam 10 in that its tendons 42 have horizontal center sections **42*a* running along the bottom of the beam 40 between two lower plates 44, being attached to the ends of the beam at the top by top plates 46 in the same manner as the beam 10. Accordingly, the upward anti-sagging force is applied to the bottom of the beam 40** at two space-apart locations and the unsupported portion of the beam is reduced in length. This construction is more suitable for a longer beam.

It will be appreciated from the description above that the present invention provides improved beams and other structural members of fiberglass construction which have the strength and fire resistant properties of heavier conventional members. These new beams possess the added advantage of an adjustable anti-sag arrangement which permits them to be adapted to a variety of load conditions. In relation to its size and weight, the beams of the invention can have greatly increased strength when compared to more conventional structural members such as glue-lam beams. In addition, the beams are hollow to provide a raceway for electrical conduits and the like and are not subject to rotting or insect infestation. It should be also noted that, while exemplary three layer beams are described above, the number of layers can be increased for larger beams with alternating fiberglass and gypsum board.

While particular forms of the invention have been illustrated and described, it will be apparent that various modifications can be made without departing from the spirit and scope of the invention.

I claim:

1. A structural member for use as a beam, a column, or the like comprising:

an elongated, closed, multi-sided inner layer of fiber and resin material having substantial load-bearing capacity;

an elongated, closed, multi-sided outer layer of fiber and resin material surrounding said inner layer and having substantial load-bearing capacity;

a middle layer of fire retardant, heat resistant, insulating material firmly and tightly held between said inner and outer layers, whereby said middle layer acts as a spacer to rigidify said member; and at least one tendon extending in tension between two ends of said members.

2. The structural member of claim 1 wherein said inner and outer layers are filament wound fiberglass wrapped in a direction substantially perpendicular to the elongation of said member.

3. The structural member of claim 1 wherein said middle layer is gypsum board.

4. The structural member of claim 1 further comprising a mandrel on which said inner layer is wound.

5. The structural member of claim 1 wherein said tendon is anchored to surfaces of said member near the ends thereof and is anchored at one or more offset intermediate points.

6. A beam comprising:

a mandrel including four elongated, parallel corner pieces;

an inner layer of filament wound fiberglass wrapped around said mandrel to form an elongated, box-like, four-sided structure of substantial load-bearing capacity.

a fire retardant middle layer of gypsum board surrounding and contacting all four sides of said inner layer;

an outer layer of filament wound fiberglass having substantial load-bearing capacity wrapped firmly and tightly around said middle layer, whereby said middle layer acts as a spacer between said inner and outer layers to rigidify said beam; and at least one tendon extending in tension between two ends of said beam, said tendons being anchored to the top of said beam at said ends thereof and being anchored to the bottom of said beam at one or more intermediate points, thereby preventing sagging of said beam;

said inner layer being substantially free of internal load-bearing structure other than said tendons and said mandrel.

* * * * *